US009240087B2

(12) United States Patent
Billet et al.

(10) Patent No.: US 9,240,087 B2
(45) Date of Patent: Jan. 19, 2016

(54) RECEIPTING AND DISPENSING BANKNOTE MODULE FOR EQUIPMENTS OF AUTOMATIC DEPOSIT AND WITHDRAWL OF BANKNOTES

(75) Inventors: Mirko Billet, Bollengo (IT); Mauro Martinotti, Bollengo (IT); Mario Perino, Bollengo (IT); Renato Bortolin, Bollengo (IT); Carlo Simonotti, Bollengo (IT); Ivan Ferrero Aprato, Bollengo (IT)

(73) Assignee: C.T.S. CASHPRO S.R.L., Bollengo (IL)

( * ) Notice: Subject to any disclaimer, the term of this patent is extended or adjusted under 35 U.S.C. 154(b) by 434 days.

(21) Appl. No.: 12/681,316

(22) PCT Filed: Oct. 1, 2008

(86) PCT No.: PCT/IB2008/054537

§ 371 (c)(1),
(2), (4) Date: Apr. 1, 2010

(87) PCT Pub. No.: WO2009/047743

PCT Pub. Date: Apr. 16, 2009

(65) Prior Publication Data

US 2010/0218707 A1 Sep. 2, 2010

(30) Foreign Application Priority Data

Oct. 12, 2007 (IT) ..... TO2007A0723

(51) Int. Cl.
*G07F 7/04* (2006.01)
*G07D 11/00* (2006.01)

(52) U.S. Cl.
CPC ..... *G07D 11/0012* (2013.01); *G07D 11/0006* (2013.01); *G07D 11/0024* (2013.01); *G07D 11/0033* (2013.01); *G07D 11/0081* (2013.01)

(58) Field of Classification Search
CPC ..... G07D 11/0009; G07D 11/0006; G07D 11/0012; G07D 11/0015; G07D 11/0021; G07D 11/0024; G07D 11/0027; G07D 11/0033; G07D 11/0045; G07D 11/006; G07D 11/0081; G07D 7/00; G07D 2207/00; G07D 2211/00
USPC ..... 194/206, 207; 209/534; 902/7–17; 271/180, 181; 235/379; 382/135
See application file for complete search history.

(56) References Cited

U.S. PATENT DOCUMENTS 4,479,049 A * 10/1984 Hirose ..... 194/206
4,554,444 A * 11/1985 Hirose ..... 235/379

(Continued)

FOREIGN PATENT DOCUMENTS

GB 2 140 186 A 11/1984
WO 2007/090899 A1 8/2007

*Primary Examiner* — Jeffrey Shapiro
(74) *Attorney, Agent, or Firm* — Sughrue Mion, PLLC

(57) ABSTRACT

Receipting and dispensing module (32-1) for equipments of automatic deposit and withdrawal of banknotes including a banknote seat (234) for storing banknotes (32) with arrangement in superimposition and subdivision in two banknote stacks (238*f* and 238*r*) and a couple of insertion and extraction devices (241*f* and 241*r*) for the insertion and the extraction of the banknotes. The banknote seat (234) is usable by each banknote stack and the insertion and extraction devices are arranged at the ends of the banknote seat. The module (32-*i*) comprises an input-output passage (82) and a diverting member (246) controllable for causing the banknotes to transit between the input-output passage (82) and one or the other insertion and extraction device. Guiding and moving elements (247) are provided for guiding and moving the banknotes between the diverting member (246) and one (241*r*) of the insertion and extraction devices (241*f* and 241*r*).

3 Claims, 10 Drawing Sheets

(56) References Cited

U.S. PATENT DOCUMENTS

| | | | | |
|---|---|---|---|---|
| 4,731,523 | A | 3/1988 | Kozima | |
| 4,903,955 | A * | 2/1990 | Manzke | 271/176 |
| 6,318,714 | B1 | 11/2001 | Beskitt et al. | |
| 6,435,329 | B1 * | 8/2002 | Amari et al. | 194/206 |
| 6,533,261 | B2 * | 3/2003 | Katou et al. | 271/3.12 |
| 6,889,849 | B2 * | 5/2005 | Heidel et al. | 209/534 |
| 7,243,914 | B2 * | 7/2007 | Tokunaga et al. | 271/3.01 |
| 7,249,707 | B2 * | 7/2007 | Yokoi et al. | 235/379 |
| 8,033,542 | B2 * | 10/2011 | Bisone et al. | 271/179 |
| 2004/0256450 | A1 * | 12/2004 | Fujioka | 235/379 |

* cited by examiner

RECEIPTING AND DISPENSING BANKNOTE MODULE FOR EQUIPMENTS OF AUTOMATIC DEPOSIT AND WITHDRAWL OF BANKNOTES

FIELD OF THE INVENTION

The present invention relates to a banknote receipting and dispensing module for an equipment of automatic deposit and withdrawal of banknotes.

More specifically, the invention relates to a banknote receipting and dispensing module or box for equipments of automatic deposit and withdrawal of banknotes and a respective equipment of automatic deposit and withdrawal of banknotes according to the introductory portions of the main claims.

BACKGROUND OF THE INVENTION

Equipments for the automatic deposit and withdrawal of banknotes are used in banking sites, as help for tellers or as "self service" equipments operable by customers, for banking transactions comprising the deposit and the withdrawal of cash. These equipments provide banknote receipting and dispensing modules or boxes, having function of recycling, mountable with possibility of replacing in respective housings, and in which each module or box is provided of a seat associated to a given typology of banknotes. For high storing capacity, modules or boxes are often preferred in which the banknotes are arranged as a stack with horizontal extension and support on a longer edge.

The number of employed housings and modules or boxes determines denominations and/or typologies of the banknotes to be handled, as well as dimensions and cost of the equipment. Therefore, in the case of vertically overlapped boxes, the number of the housings affects the overall height of the equipment. As an example, an equipment which proposes to recycle banknotes of the EURO system should provide seven modules or boxes, respectively, for the denominations of: 5, 10, 20, 50, 100, 200 and 500 Euro, and seven respective housings.

In the use, the boxes associated with the denominations or typologies of banknotes of reduced circulation, for instance the boxes for banknotes of 200 and 500 Euro, are generally subject to a limited number of storage and dispensing operations, for small quantities and reduced occupation of the seats. On the contrary, the boxes lodging the denominations of banknotes of greater circulation, for instance banknotes of 20 and 50 Euro, should satisfy high requests of storage and dispensing, often varying in the time.

The room provided in the equipment for the deposit of banknotes is therefore used in a non optimal way. Moreover, the boxes for the banknotes of greater circulation can easily reach the conditions of full box or empty box and blocking of the equipment: The emptying and recharging operations of the boxes should be frequent with increasing of the overheads. On the other hand, the addition of housings for the boxes of banknotes with greater circulation is expensive and it is often impracticable in view of current rules on the limits of height of the equipments.

Banknote processing equipments are known which use double modules for the deposit and the automatic withdrawal of banknotes, with function of recycling. These modules include a banknote seat with arrangement of the banknotes in superimposition and subdivision in two banknote stacks, and a couple of insertion and extraction devices. The stacks occupy together the banknote seat; the insertion and extraction devices are adjacent to terminal sections of the seat and insert and extract the banknotes by means of the transport mechanisms of the equipment. The room of the banknote seat is used in optimized way, but the equipment should provide, by opposite sides of the housings, two transport mechanisms for the two stacks of banknotes of the common seat. It creates problems of access in one or in both transport mechanisms, when an inspection is necessary or in the case of jam of the banknotes in movement.

SUMMARY OF THE INVENTION

An object of this invention is to accomplish a receipting or dispensing module or box for equipments of automatic deposit and withdrawal of banknotes which allows to process two different typologies of banknotes, which results reliable, of relatively contained cost, and in which the operations on the modules or boxes are easy.

According to a characteristic of the present invention, the banknote receipting and dispensing module is employable in an equipment for the deposit and the withdrawal of banknotes and includes a banknote seat for storing banknotes with arrangement in superimposition and subdivision in two banknote stacks along a given stacking direction and a pair of insertion and extraction devices for the insertion and the extraction of the banknotes. The banknote seat is usable by each one of the stacks and the insertion and extraction devices are arranged at the ends of the seat. The module includes: a single input-output passage for the banknotes regarding the two stacks; and a diverting member controllable for making the banknotes to selectively transit between the input-output passage and the one or the other insertion and extraction device. Guiding and moving elements are provided for guiding and moving the banknotes between the diverting member and at least one of the insertion and extraction devices.

According to another characteristic, a double box includes a reference surface for the stacks of banknotes in vertical and supporting belts, associated with each one of the two stacks, projecting of a little with respect to the reference surface. The supporting belts of a given stack extend from the pressing element to a respective terminal section of the seat, returning toward the other terminal section and in which each belt has an end fixed to the pressing element and an opposite end arranged underneath the reference surface. Restoring members are provided for maintaining in tension the belts during the movement of the pressing elements.

Further, according to another characteristic, the banknote stacks have vertical arrangement with support of the banknotes on the longer edges and a double box comprises a pair of pressing elements to push, in independent way, the banknote stacks against the insertion and extraction devices. The pressing elements include respective carriages having a moving member on board and specular configuration for minimum dimensions in condition of maximum filling of the banknote seat.

BRIEF DESCRIPTION OF THE FIGURES

The characteristics of the invention will become clear from the following description given purely by way of non-limiting example, with reference to the appended drawings in which.

DETAILED DESCRIPTION OF THE PREFERRED EMBODIMENTS

Figure 1:
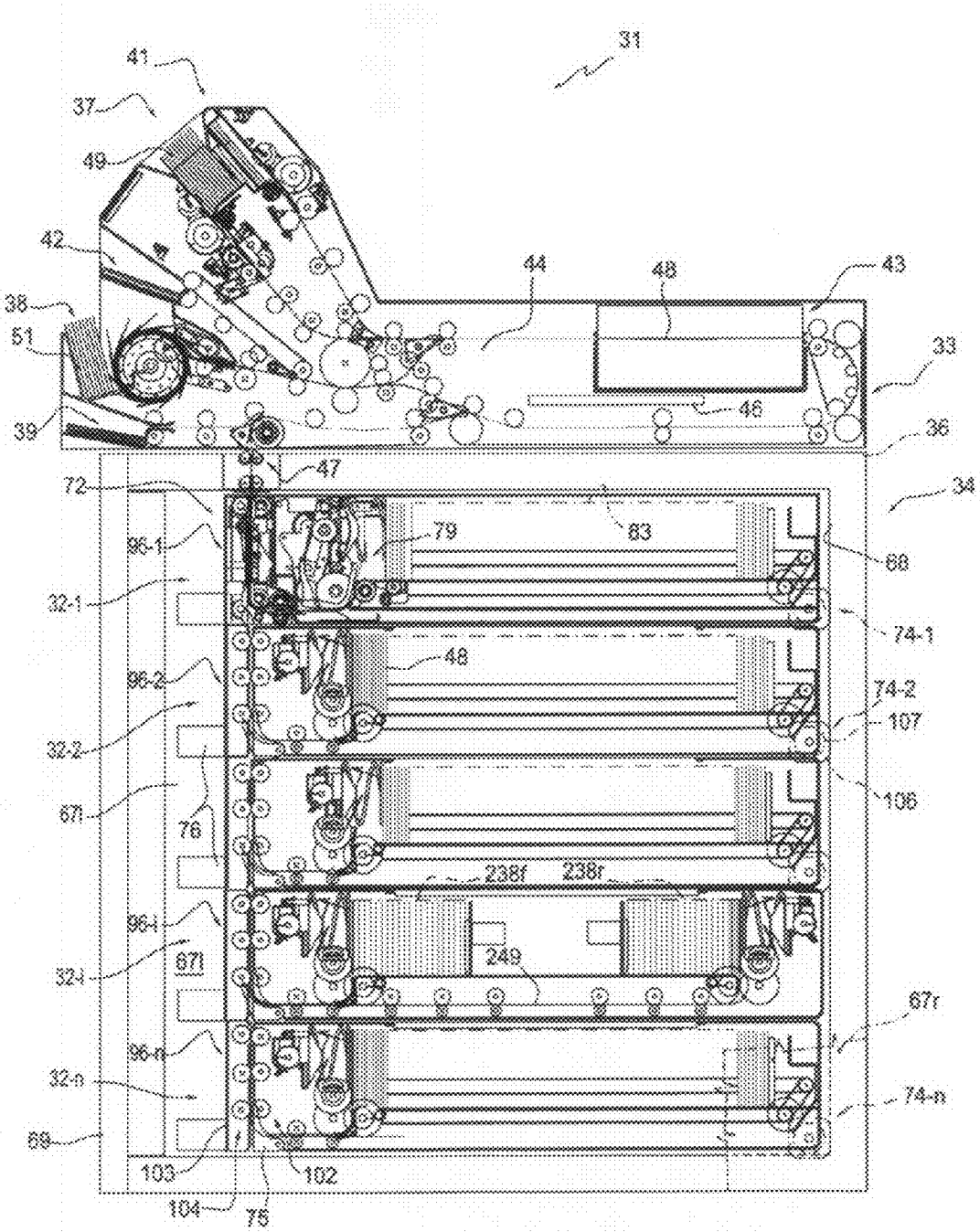
FIG. 1 represents a schematic lateral view of an equipment for deposit and automatic withdrawal of banknotes and respective receipting or dispensing modules or boxes according to the invention, in condition of use.

The FIG. 1 represents, in schematic shape, an equipment 31 for the deposit and the automatic withdrawal of banknotes, with a series of receipting or dispensing modules or boxes 32-1, 32-2, . . . , **32-*n***, from now onwards defined as receipting and dispensing boxes, of the type described in the Italian Patent Application TO2007A000721, filed on Dec. 10, 2007 in the name of the Applicant CTS Cashpro S.p.A. and whose contents are included, as reference, in the present description. The herein described and represented components maintain the same numeration of the components with identical functionality of the cited application TO2007A000721.

The equipment 31 includes, vertically overlapped, an upper body 33 and a lower body 34: The upper body is of interface for the operator, while the lower body is defined by a store-safe 36 in which the boxes 32 1, 32 2, . . . , **32-*n* are mounted. The equipment 31 can process flexible documents different by the banknotes, as checks and notes. Anyway, from now onwards, the term banknotes will also designate these flexible documents. The boxes include the box 32-*i*, similar to the other boxes 32 1, 32 2, 32*n*** but having components and functions specific of the present invention.

The upper body 33 includes, in a conventionally frontal portion, an input port 37 for depositing and introducing the banknotes, an output port 38 for their dispensing, a forgery vane 39, a deposit rejection vane 41 and a withdrawal rejection vane 42. The input port 37 and the output port 38 are open and are accessible to the user, while the vanes 39, 41 and 42 are accessible through keys. Moreover, are in evidences inside the body 33: a validation device 43 in a rear portion, an interface transport mechanism 44, an electronic control unit 46 and an input-output port 47, of connection with the store-safe 36.

The input port 37 and the output port 38 are provided for receiving banknotes introduced by the user as a deposit stack 49 and, respectively, for receiving the banknotes requested by the user as a withdrawal stack 51. The forgery vane 39 receives the banknotes suspect of forgery, the deposit rejection vane 41 is provided for receiving the components of the stack 49 rejected by the equipment 31 in phase of deposit, while the withdrawal rejection vane 42 normally receives the banknotes discarded by the equipment in the phase of withdrawal. The interface transport mechanism includes passive diverters and controlled diverters to connect the transaction ports and the vanes banknotes with the validation device 48 and with the input-output port 47.

Figure 2:
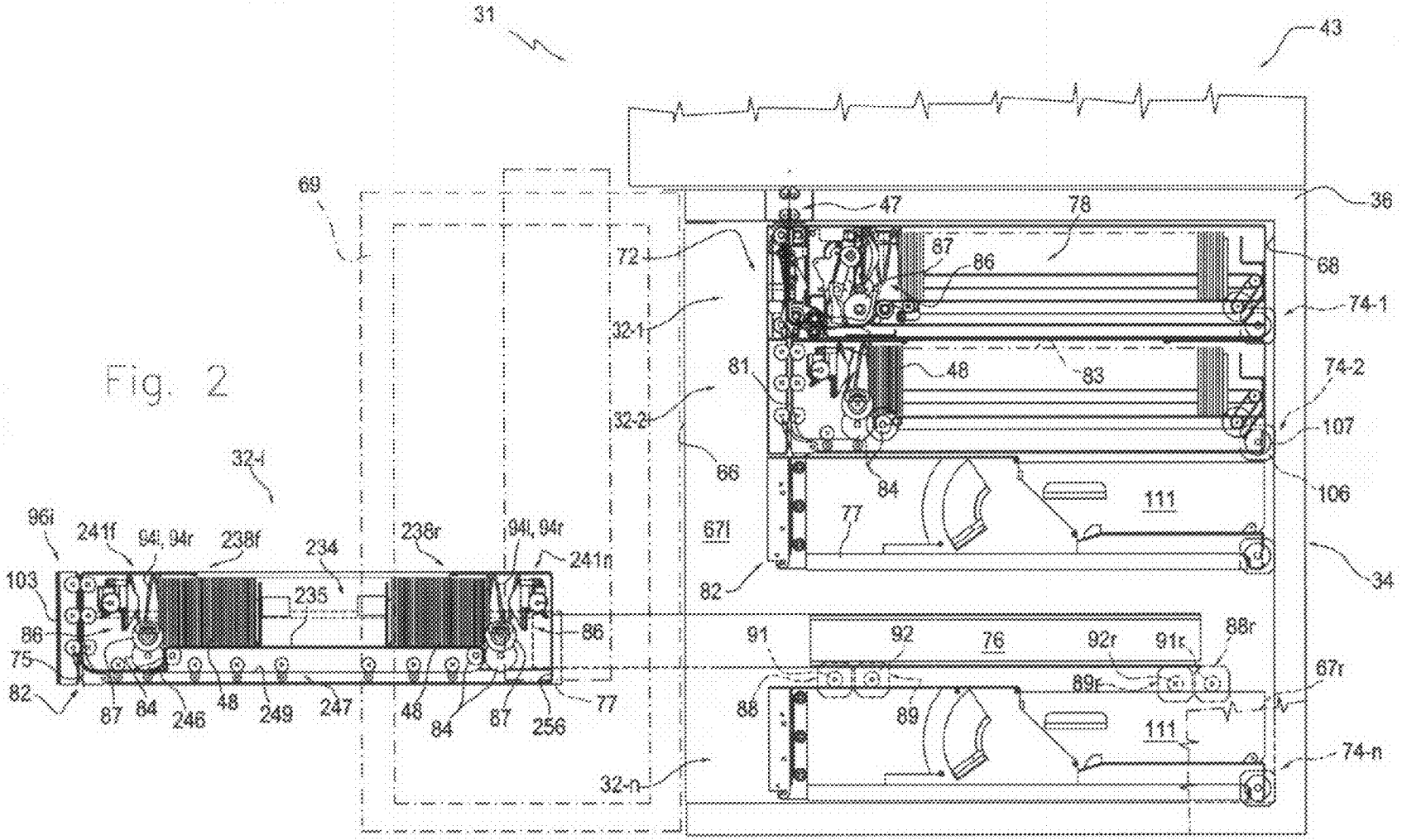
FIG. 2 shows a schematic lateral view, partial, of the equipment and the modules or boxes according to the invention, in a condition of service.

The store-safe 36 has a front opening 66, side walls **67*l* and 67*r*, a rear wall 68, a door 69 for the opening 66 and a plurality of housings for the boxes 32-1, 32-2, . . . , 32-*i*, 32-*n*. In the store-safe 36 are mounted a store transport mechanism 72, a transport moving member for the store transport mechanism and a plurality of stacking moving members 74-1, 74-2, . . . 74-*n* (FIG. 2) for the boxes 32-1, 32-2, . . . , 32-*n***.

In the store-safe, the housings for the boxes are arranged in vertical on a column and lodge each one a respective box 32. The store transport mechanism 72 has substantially vertical path and comprises diverting members 75 for the boxes 32. Through the diverting members, the transport mechanism 72 moves the banknotes 48 between the door 47 and the boxes 32. The door 69 has a safety lock, not shown in the figures, and it makes to access to the transport mechanism 72 and the boxes 32-1, 32-2, . . . , **32-*i*, 32-*n***.

Respective guides 76 are mounted on the walls **67*l* and 67*r* in the space provided for the housings of the boxes and support the boxes 32-1, 32-2, . . . , 32-*i*, 32-*n* (FIG. 2) through trays 77 slidable in horizontal between an operational position (boxes 32-1, 32-*n*) and a position of service (box 32-*i*). The operational position is inside the store-safe 36 and is functional to each box 32 for the reception and withdrawal of the banknotes 48. The position of service of the boxes is external to the store-safe 36, for an arrangement of the single boxes 32 countlever through the opening 66 and it is functional to each box for operations on the banknotes 48** associated to the emptying and the recharging and for maintenance.

The boxes 32-1, 32-2, . . . , **32-*i*, 32-*n* have dimensions and functionality similar to the dimensions and the functionality of the boxes for deposit and withdrawal of banknotes described in the Italian Patent Application TO2006A00094 filed on Oct. 2, 2006 in the name of the Applicant CTS Cashpro S.p.A. and whose contents are herein included as reference. The boxes 32-1, 32-2, . . . , 32-*i*, 32-*n* have substantially parallelepiped shape, lengthened in depth, and generically present a seat 78 for the banknotes 48 and an insertion and extraction device 79. Each box 32 shows a bottom, and a front wall 81 with an opening 82, adjacent to the bottom, of passage for the banknotes in input or in output. The banknotes 48 are arranged in vertical according to a stack 83**, with extension overposed in horizontal.

In synthesis, the insertion and extraction device 79 (FIG. 5) of each box 32 includes introduction-extraction rollers 84 for the introduction and the extraction of the banknotes, a separation member 86 for making easier the introduction of the banknotes and a separation roller 87 for the unstacking operation of the banknotes from the stack 83. The rollers 84 are arranged of few underneath the collecting seat 78 provided for the stack 83, while the separation member 86 is interposed between the input-output opening 82 and the stack of banknotes 83. The separation roller 87 is connected in the rotation, in synchronous way, with the introduction-extraction rollers 84, through a pulley and toothed belt coupling. The separation member 86 is shiftable between an operational position, downstream of the separation roller 87 in the sense of the stacking, for a configuration of deposit of the banknotes and a non-operational position, upstream of the separation roller and as represented for the box 32-2 (FIG. 2), in connection with a configuration of dispensing.

Respective configuration motors 88 (FIGS. 2 and 5) operate on the separation member 86 to motorize the single boxes 32-1, 32-2, . . . , 32-1, **32-*n*, while introduction-extraction motors 89 actuate the rotation of the introduction-extraction rollers 84. The motors 88 and 89 are mounted on the wall 67*r* of the store safe 36 and comprise respective driving gears 91 and 92 projecting from the wall 67*l* in correspondence of the housings for the boxes. In the operational position of the boxes 32, the driving gears 91 and 92 engage taking gears 90 and 93 for the separation member 86 and, respectively, for the introduction-extraction rollers 84 and for the separation roller 87. The introduction of the banknotes 48 is associated to a given sense of motion of the motor 89, while the extraction is associated to an opposite sense of motion. The stack of banknotes 83** of each box is moved jointly to the introduction and the extraction of the banknotes by means of a pressing element actuated by a respective member of motorization.

Similarly to what described in the cited Italian Patent Application TO2006A00094, the separation member 86 for each box 32 includes two insertion spiral elements for banknotes, represented with **94*l* and 94*r*, extended in the sense of the stacking, for overposing the banknotes to be deposited on a terminal surface of the stack 83: The spirals 94*l* and 94*r* are rotated by the driving gear 91 of the respective motor 88, through the taking gear 90 (FIG. 5) and a kinematic chain comprising pulleys and toothed belts 95-1, a shaft 95-2 and conic gears 95-3**.

The spirals **94*l* and 94*r* are mounted on a carriage 95-4, which also supports the conic gears 95-3. The carriage 95-4 is moved between the operational position of the spirals 94*l* and 94*r* and the non-operational position (FIG. 7), on control of a cyclic actuation mechanism represented with 100 and described in the cited Patent Application TO2006A00094. The mechanism 100 is sensitive to the change of the sense of rotation of the introduction-extraction motor 89 and is actuated by the same motor 89 and the stacking moving member of the pressing element of the stack 83**.

In the operational position, the spirals **94*l* and 94*r* (FIG. 5) are in contact with the stacking surface of the stack of banknotes 83 and the insertion of the banknotes 48 occurs from the bottom upwards by means of the introduction-extraction rollers 84. The spirals 94*l* and 94*r* are rotated by the respective configuration motor 88 in synchronism with the movement of the entering banknotes so that the same banknotes are received, with a pre-defined phase, between the coils and are overlapped on the stacking surface. The stacking of the banknotes is rendered easier by shovel elements 116 rotatable in synchronism with the spirals 94*l* and 94*r***.

Figure 6:
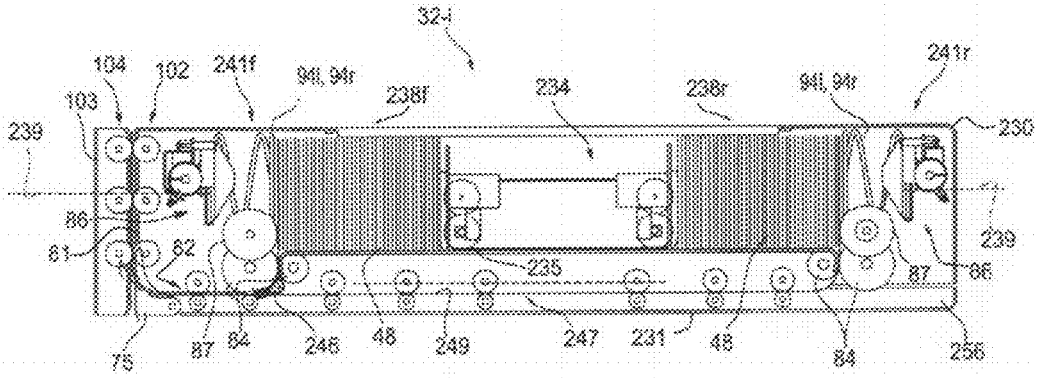
FIG. 6 represents a schematic lateral section of the module or box of FIG. 4, in another operational condition.
Figure 8:
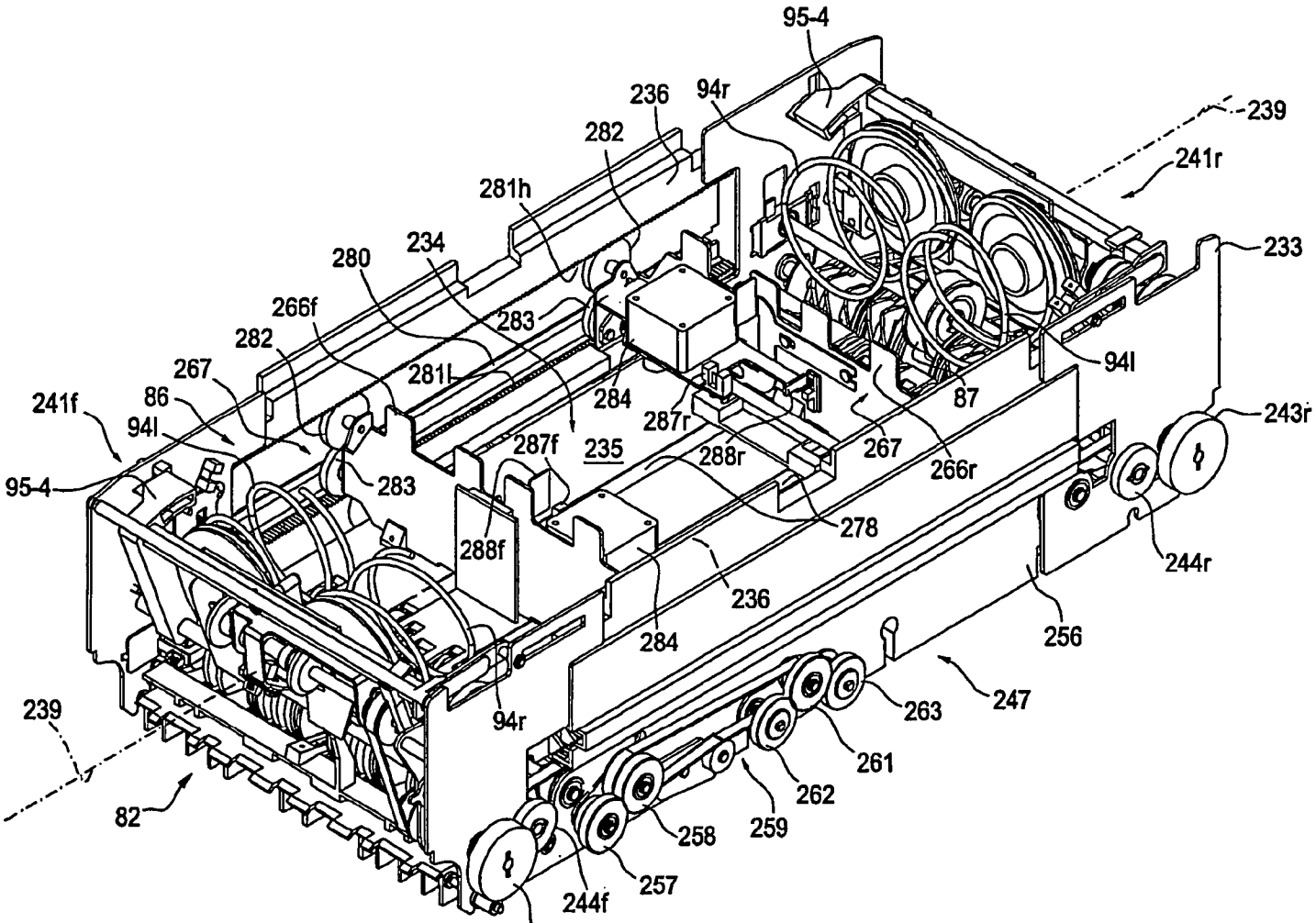
FIG. 8 is a schematic perspective view of internal components of the banknote receipting and dispensing box according to the invention.

In the non-operational position of the spirals **94*l* and 94*r* (FIG. 7), the stacking surface of the stack of banknotes 83 is in contact with the separation roller 87. The respective introduction-extraction motor 89 make the roller 87 to rotate through the taking gear 93 and a kinematic chain comprising pulleys and toothed belts, extracting the banknotes 48 by the stack 83 from the top downwards. Then, the extracted banknotes are moved toward the diverting member 75 (FIGS. 2 and 6) and the transport mechanism 72, by means of the introduction-extraction rollers 84**.

The store transport mechanism 72 (FIGS. 1 and 2) of the equipment 31 has individual sections 96-1, 96-2, **96-*i*, . . . 96-*n*, associated with the single boxes 32-1, 32 2, . . . , 32-*i*, 32-*n*, and mounted on the same boxes. These sections 96-1, 96-2, . . . , 96-*i*, 96-*n* are moved together with the boxes 32-1, 32-2, . . . , 32-*i*, 32-*n* in the positions of service and have possibility of access to corresponding fractions of the banknote path between the boxes and the input-output port 47. The individual sections 96-1, 96-2, . . . , 96-*i*, 96-*n* take the motion or directly through the member of motorization 73, or from another of the individual sections. The respective diverting members 75 are also mounted on the boxes 32, adjacent to the opening 82**.

The transport moving member 73 includes a transport motor and a motor pinion, not shown, mounted in the store safe 36. The individual sections 96-1, 96-2, . . . , **96-*i*, 96-*n* include each one one a taking gear in an upper portion of the box 32 and, in a lower portion, a transmission gear, which is connected in the rotation with the taking gear. In the operational position of the boxes 32, the sections 96-1, 96-2, . . . , 96-*i*, 96-*n*** take the motion or by the motor pinion or by the transmission gear of the upper section, while these sections are disengaged by the transport mechanism in the positions of service of the boxes.

The individual sections 96-1, 96-2, . . . , **96-*i*, 96-*n* include each one a series of box transport rollers 102 supported in the rotation by the front wall 81, a frame 103 fulcrumed in correspondence of the passage opening 82 of the box 32 and a series of counter rollers 104 supported in the rotation by the frame 103. The transport rollers 102 are connected in the rotation with the taking gear of the box. The frame 103 is shiftable between a position of transport, adjacent to the wall 81 and in which the counter-rollers 104 oppose the transport rollers 102 and a position of access in which the counter-rollers 104 are spaced away from the rollers 102**.

In the position of transport of the frame 103 and for the operational position of the box 32, the box transport rollers 102 and the counter-rollers 104 define fractions of path and shifting of the banknotes in front of the boxes 32-1, 32-2, . . . , **32-*i*, 32-*n*, together with corresponding guide elements of known type. Under these conditions, a banknote in movement along this fraction of the section 96-1, 96 2, . . . , 96-*i*, 96-*n* can proceed toward the upper or lower box 32 or be deviated toward the banknote seat 78 by means of the member 75. Likewise, a banknote 48 emerging from the box 32 can be deviated by the member 75 toward the rollers 102 and the counter-rollers 104 along the fraction of the section 96-1, 96-2, . . . , 96-*i*, 96-*n* and toward the opening 82. In the position of service of the box 32, the frame 103 can be moved away from the wall 81 for the possible removal of banknotes clogged in the section 96-1, 96-2, . . . , 96-*i*, 96-*n* and in condition of liberty of the transport rollers and the diverting member 75**.

The boxes 32-1, 32-2, . . . , **32-*n*, for instance the box 32*n*, can be of removable type, as described in the cited Patent Application TO2007A000721, comprising a base structure 109 and a recycling container 111. in which is defined the seat 78 for the banknotes 48. The container 111 is mountable and removable with respect to the structure 109 and it is coupable with respect to the insertion and extraction device 79 of the box. The device 79 interfaces the transport mechanism 72, while the box 111 is engageable with the stack 83 for entering the banknotes in the box and, in alternative, for singularly extracting the banknotes. The container 111 is removable from the insertion and extraction device 79 and it is coupable with the device 79 in the position of service of the respective box 32**.

Figure 3:
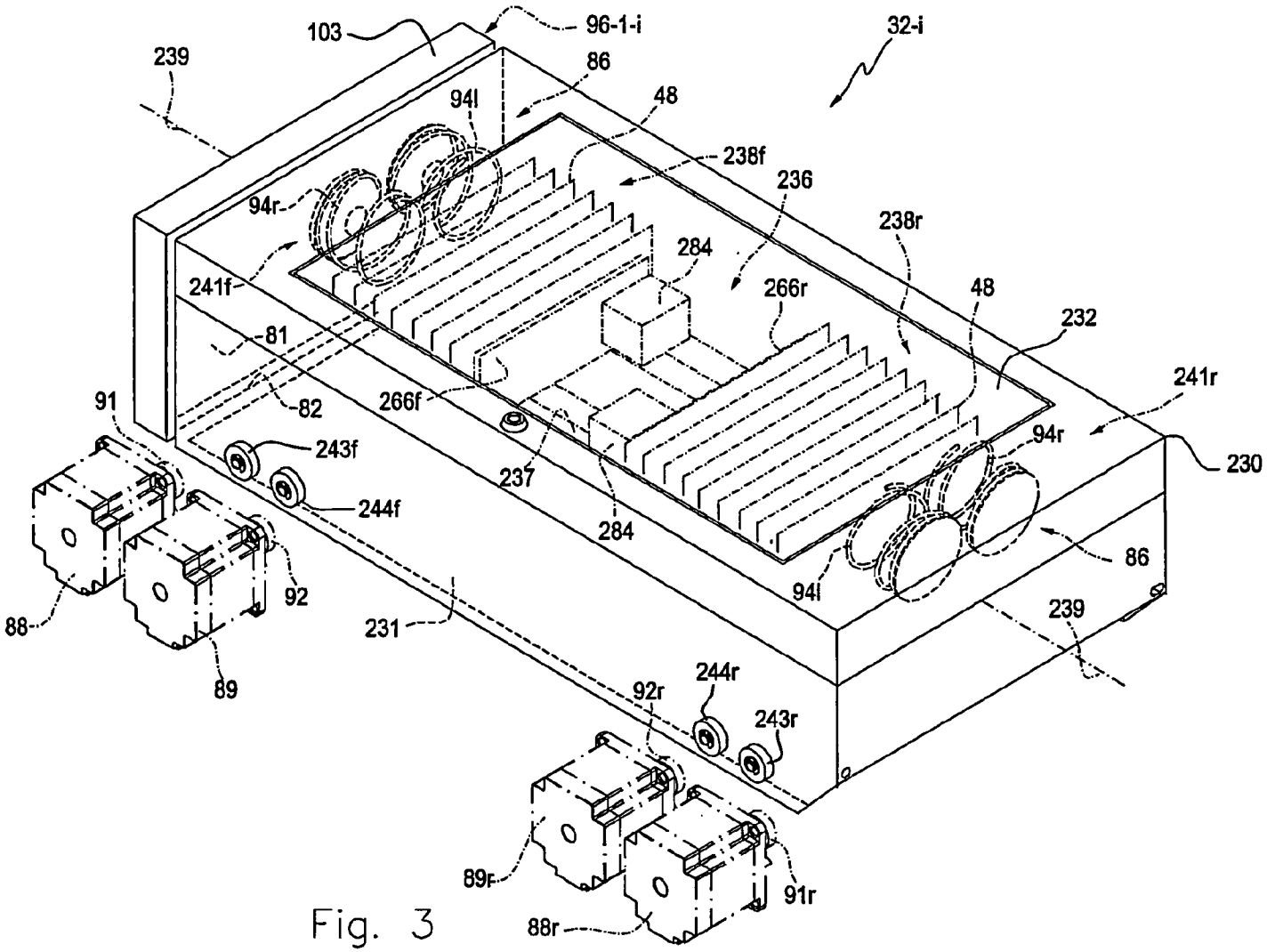
FIG. 3 is a schematic perspective view of a banknote receipting and dispensing box according to the invention.
Figure 4:
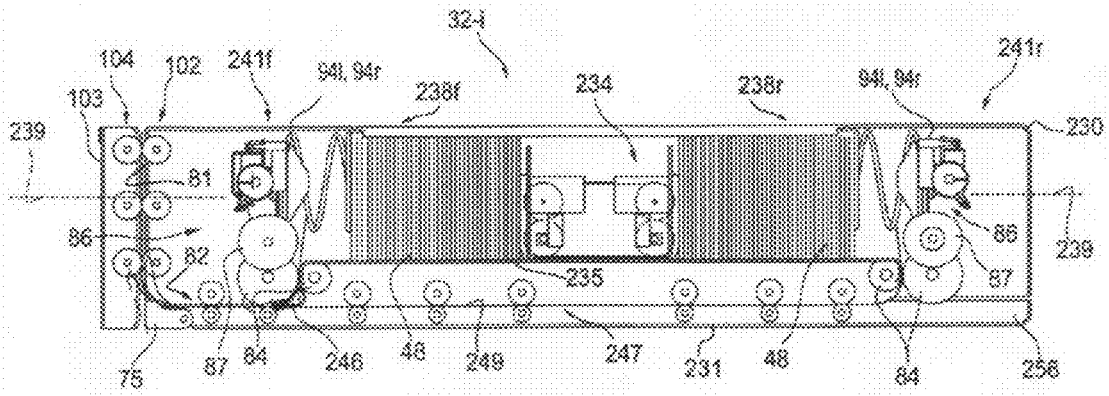
FIG. 4 represents a schematic lateral section of the module or box of the invention in a given operational condition.

According to the invention, the box 32-*i* comprises an envelope 230 (FIGS. 3, 4 and 6), of lengthened substantially parallelepiped shape, which frontally supports the individual section 96-*i* of the transport mechanism store 72 and the diverting member 75 and includes a bottom 231 and the front wall 81, and in which the opening 82 is arranged on the wall 81, adjacent to the bottom 231. The envelope 230 is provided of a cover 232 with lock, and internally has a frame 233 (FIGS. 3, 4, 6, 8, 9), with a banknote seat, herein represented with 234. The seat 234 is of lengthened substantially parallelepiped shape, horizontal in the use, open at the front and back ends, and which is delimited in a lower part by a plate of base 235 and laterally by two walls 236, and with two terminal sections 237*f* and 237*r*. The plate of base 235 defines a reference surface for the seat 234, of a little above the diverting member 75 and the opening 82.

The box 32-*i* stores, in the seat 234, banknotes 48 (FIGS. 3 and 9) of two different typologies, arranged in vertical and support on the longer edge. The banknotes are divided in two banknote stacks 238*f* and 238*r*, similar to the stacks 83 of the other boxes 32, arranged one behind the other along a common horizontal stacking direction 239. The stacks 238*f* and 238*r* define respective insertion and unstacking surfaces adjacent to the terminal sections 237*f* and 237*r* and have possibility of use of the whole useful space of the seat 234 between the terminal sections 237*f* and 237*r*. The frame 233 supports in the front and the back a pair of insertion and extraction devices 241*f* and 241*r*, and in which the device 241*f* is adjacent to the opening 82.

Thus, the insertion and extraction devices 241*f* and 241*r* are arranged in correspondence of the terminal sections 237*f* and 237*r* and provide to the orderly stacking of the banknotes on the insertion and unstacking surfaces of the stacks 238*f* and 238*r* and to the unstacking operation. The devices 241*f* and 241*r* are identical each the other and similar to the above described insertion and extraction device 79. Specifically, each device 241*f*, 241*r* includes the introduction-extraction rollers 84 for moving the entering banknotes and the emerging banknotes, the separation member with the spiral elements 94*l*, 94*r* for stacking the entering banknotes, the separation roller 87 for separating the stacked banknotes and the cyclical actuating mechanism 100 (See FIG. 7) for modifying the configuration of the spiral elements 94*l*, 94*r* between deposit and dispensing. The shovel elements 116 are also included, in correspondence of the terminal sections 237*f* and 237*r* for making easier the stacking of the banknotes.

In each stack 238*f*, 238*r*, the cyclical actuating mechanism 100 moves the spiral elements 94*l*, 94*r* between the operational position, downstream of the separation roller 87 in the sense of the stacking, for the configuration of deposit and a non-operational position, upstream of the separation roller, for the configuration of dispensing. In the condition of deposit (FIGS. 4 and 5), the banknotes enter through the opening 82 and are stored, with stacked arrangement, in the seat 234. In the condition of dispensing (FIGS. 6 and 7), the stacked banknotes are separated and emerge from the opening 82.

Figure 5:
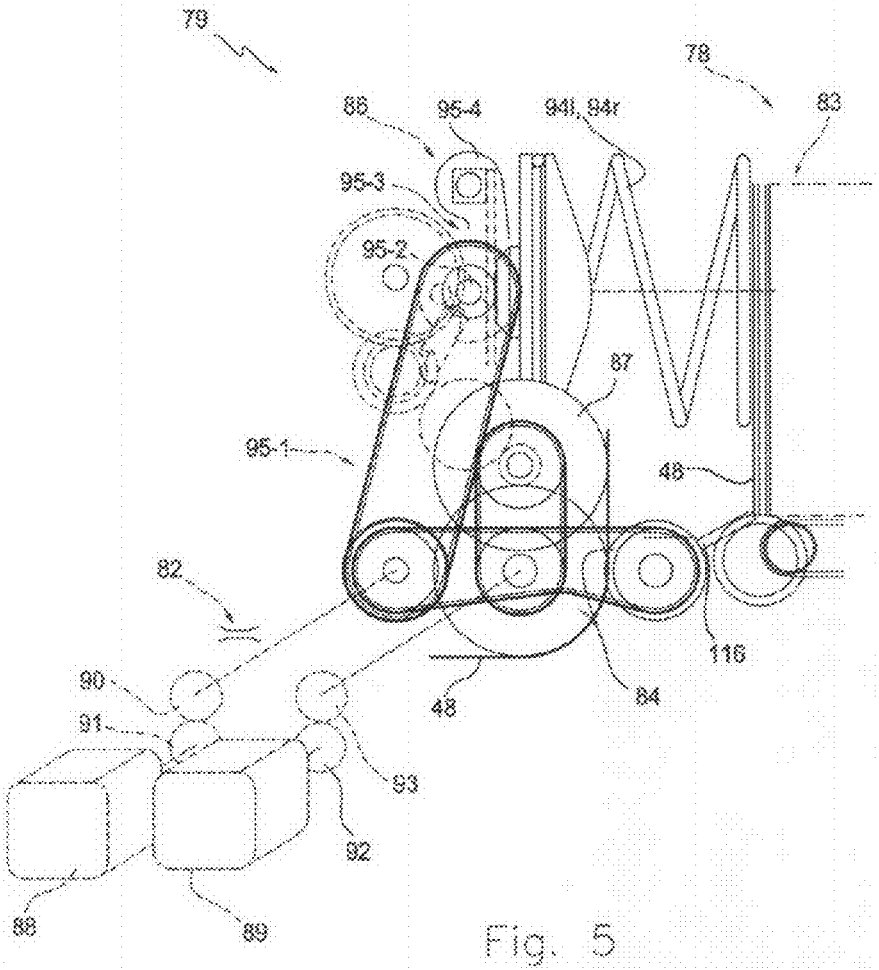
FIG. 5 shows a partial scheme of a device employed by the module or box of the invention in the operational condition of FIG. 4.
Figure 7:
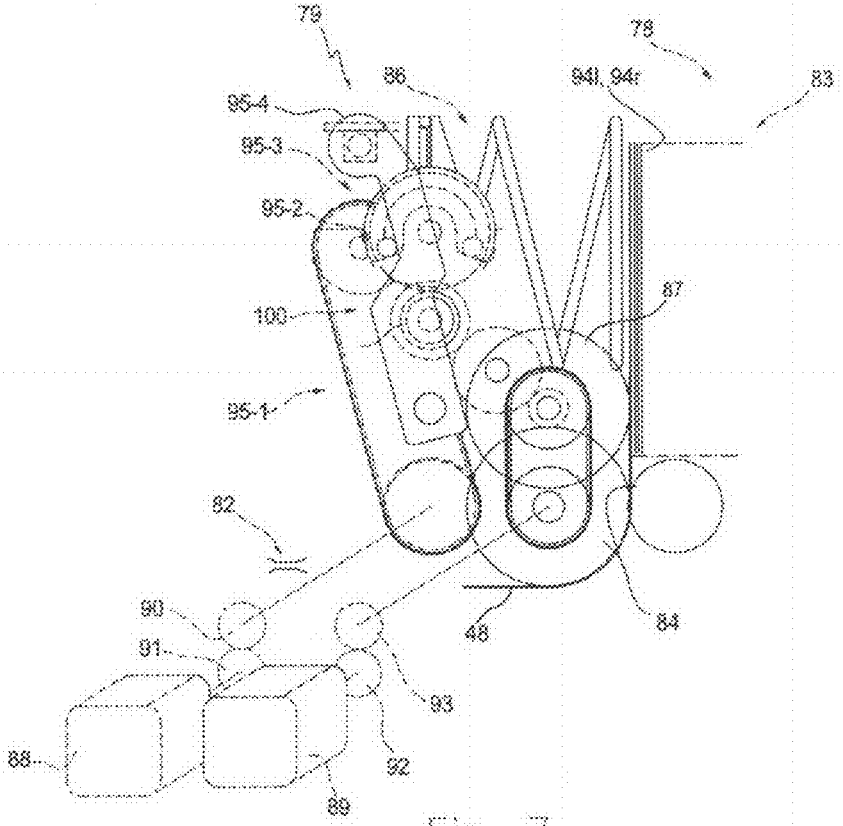
FIG. 7 shows a partial scheme of a device employed by the module or box of the invention in the operational condition of FIG. 6.
Figure 11:
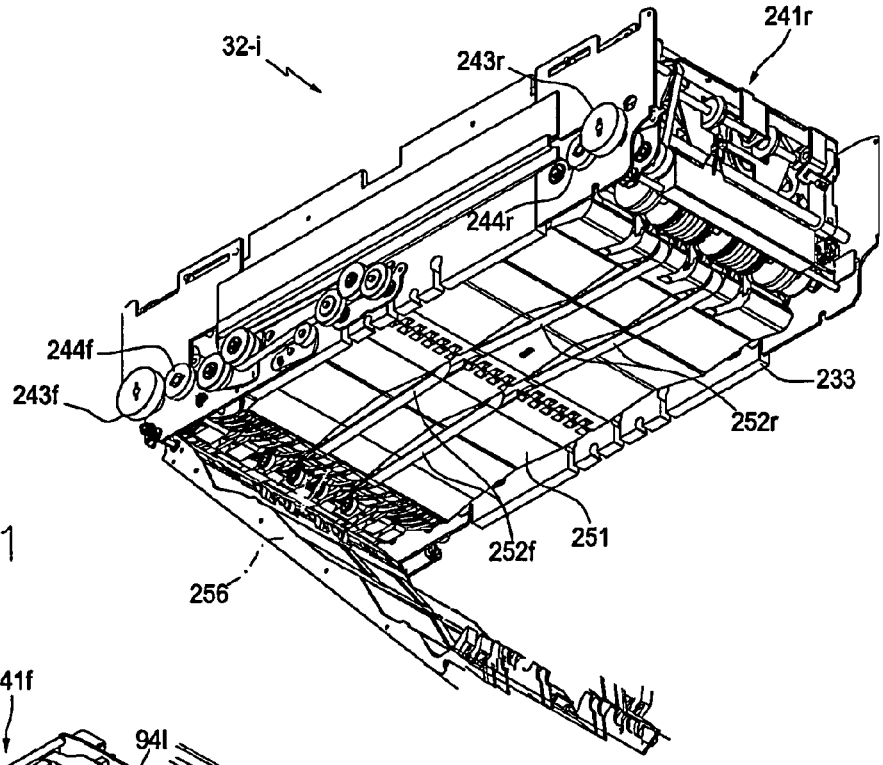
FIG. 11 is a perspective view from the bottom of some components of the module or box of the invention in a given condition of service.

Two configuration taking members 243*f* and 243*r*, (FIGS. 3, 11 and 12), similar to the gear 90 of the FIGS. 5 and 7, control the rotation of the spiral elements 94*l*, 94*r*, while two introduction-extraction taking members 244*f* and 244*r*, similar to the gear 93 of the FIGS. 5 and 7, actuate the introduction-extraction rollers 84 and the separation roller 87. The taking members 243*f* and 244*f* are arranged in the front portion of the box 32-*i*; while the taking members 243*r* and 244*r* are arranged in the rear portion, with arrangement inverted with respect to that of the taking members 243*f* and 244*f*. In condition of use, the taking members 243*f* and 244*f* are engageable by the gears 91 and 92 of the configuration control motor 88 and of the introduction-extraction motor 89. The gear 91 provides to the rotation and the phasing of the spiral elements 94*l*, 94*r* of the device 241*f* and of the shovel elements 116, while the gear 92 provides to the rotations of the separation roller 87 and the introduction-extraction rollers 84 attaining to the stack 238*f* and to the functions regarding the actuation of the mechanism 100.

The equipment 31 (FIGS. 2 and 3) comprises, at least for the housing of the box 32-*i*, besides the motors 88 and 89, a configuration control motor 88*r* and an introduction-extraction motor 89*r*, similar to the motors 88 and 89. The motors 88*r* and 89*r* have respective driving gears 91*r*, 92*r* projecting from the wall 67*r* in proximity of the rear wall and arrangement inverted with respect to the arrangement of the motors 88 and 89 and the gears 91 and 92. In the operational position of the box 32 the, the driving gear 91*r* of the motor 88*r* engages the taking member 243*r* for the rotation of the spiral elements 94*l*, 94*r* of the device 241*r* and of the shovel elements 116 of the terminal sections. In turn, the driving gear 92*r* engages the taking member 244*r* for the rotations of the separation roller 87 and the introduction-extraction rollers 84 and for the actuation of the cyclic actuation mechanism 100 which attains to the stack 238*r*.

Figure 13:
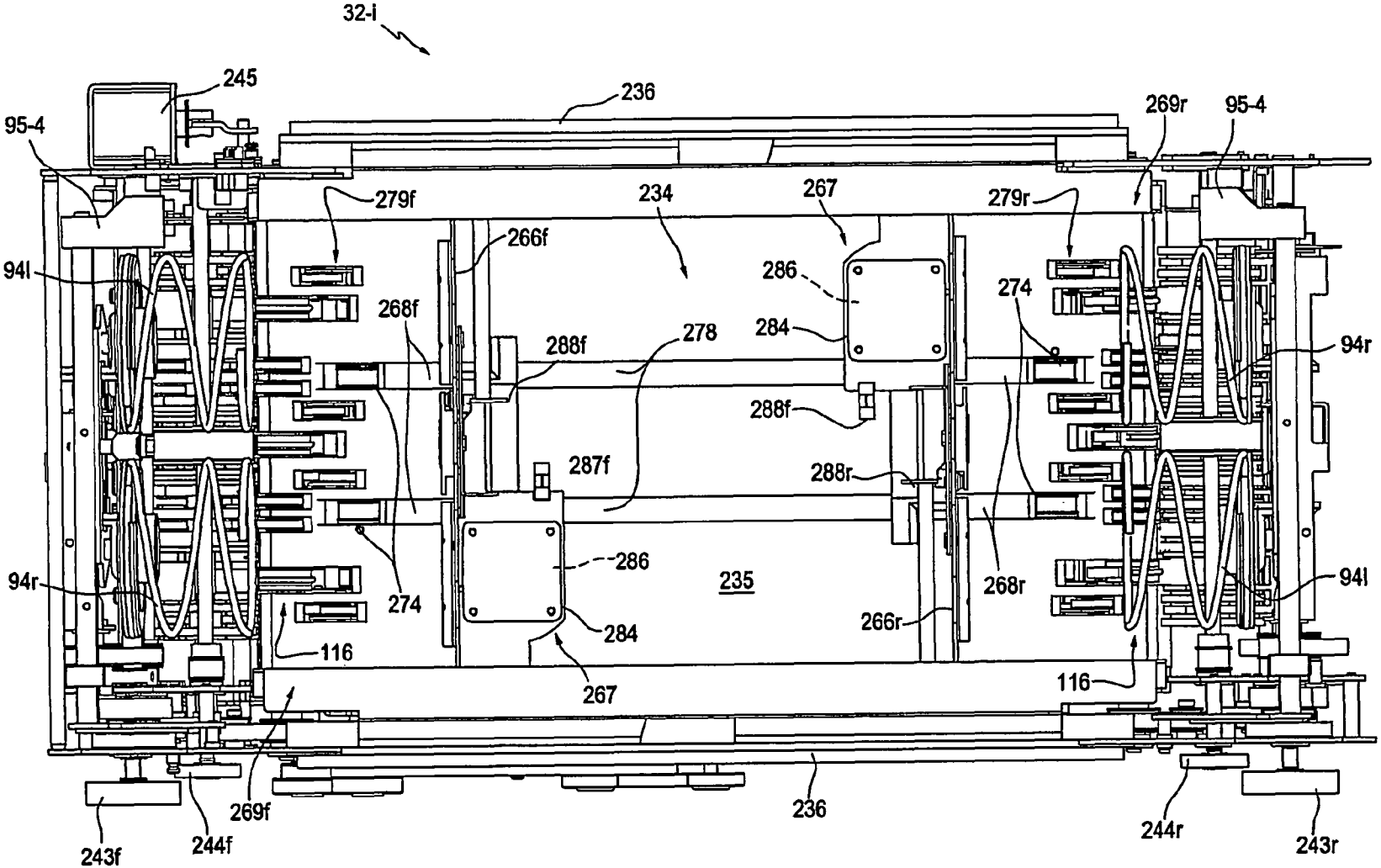
FIG. 13 is a plan view of some components of the module or box of the invention.

According to the invention, the double box 32-*i* (FIGS. 3, 4, 6, 8 and 9) provides introduction and extraction of the banknotes of the two stacks 238*f* 238*r* through a common input-output passage, constituted, for instance, by the opening 82. The double box further comprises a diverting member 246 for making the banknotes to transit between the input-output passages and the insertion and extraction devices 241*f* and 241*r*, and guiding and moving elements 247 for the banknotes arranged between the diverting member 246 and at least one of the insertion and extraction devices 241*f* and 241*r*. The diverting member 246 is controllable by the electronic unit 46 of the equipment 31, for instance through an electromagnet 245 (FIG. 13).

In the herein described embodiment, the insertion and extraction device 241*f* is considered as a reference device with respect to the devices 241*f* and 241*r*. The diverting member 246 (FIGS. 4, 6 and 9) is arranged in the front portion of the box 32-*i*: Thus, the banknotes in movement toward the device 241*f* or coming from the device 241*f* a direct path between the diverting member 246 and the introduction-extraction rollers 84. In turn, the guiding and moving elements 247 define an alternative path 249 for the banknotes in transit between the diverting member 246 and the introduction-extraction rollers 84 of the device 241*r*, in the rear portion of the box 32-*i*.

In synthesis, the guiding and moving elements 247 (FIGS. 9, 10, 11 and 12) include upper guiding plates 251 and upper belts 252*f* and 252*r* mounted on the frame 233 and lower guiding plates 253 and lower belts 254*f* and 254*r* mounted on a counter-frame 256, of support for the bottom 231: Two pairs of upper belts 252 and two pairs of lower belts 254 are provided for engaging and shifting the banknotes in transit along the path 249. The lower belts 254 are mounted through idle pulleys of the counter-frame 256, while the upper belts 252 are actuated by the introduction-extraction taking member 244*f*, in synchronism with the rollers 84, through motor pulleys and a kinematic chain. This chain comprises toothed wheels 257 and 258, a pulley and toothed belt transmission 259, an intermediate toothed wheel 261 and two toothed wheels 262 and 263.

Figure 9:
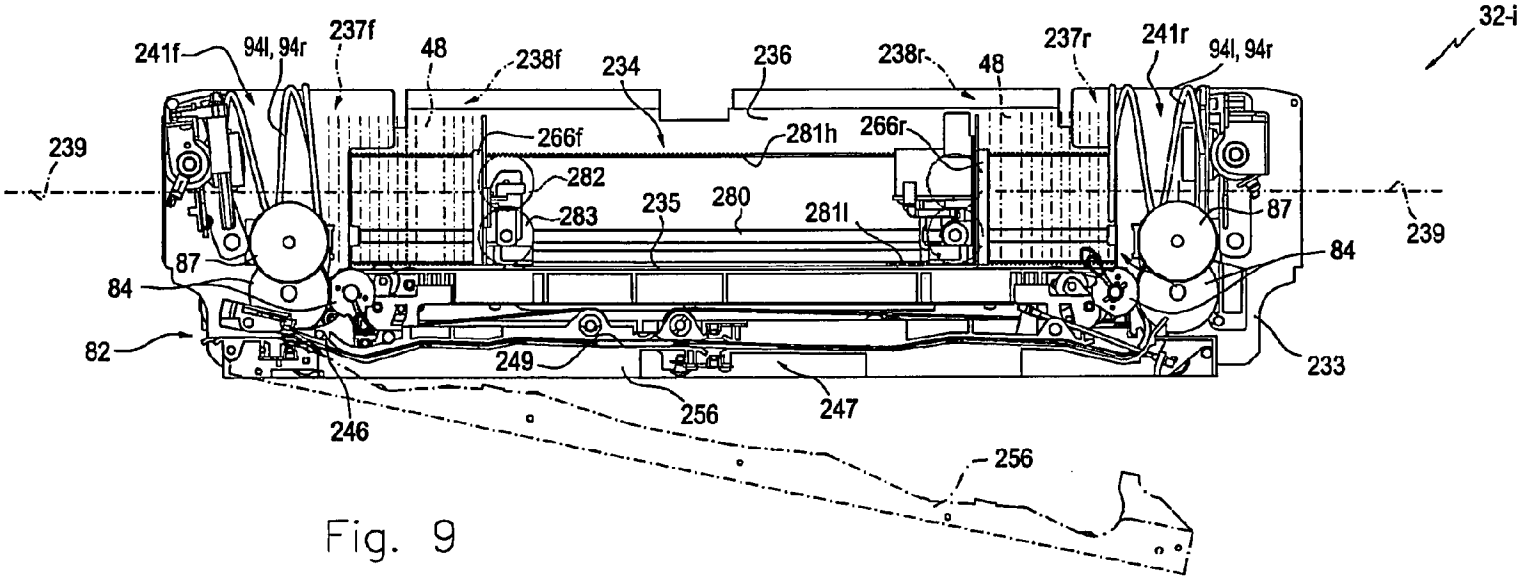
FIG. 9 shows a partial schematic lateral section of the module or box of the invention.
Figure 10:
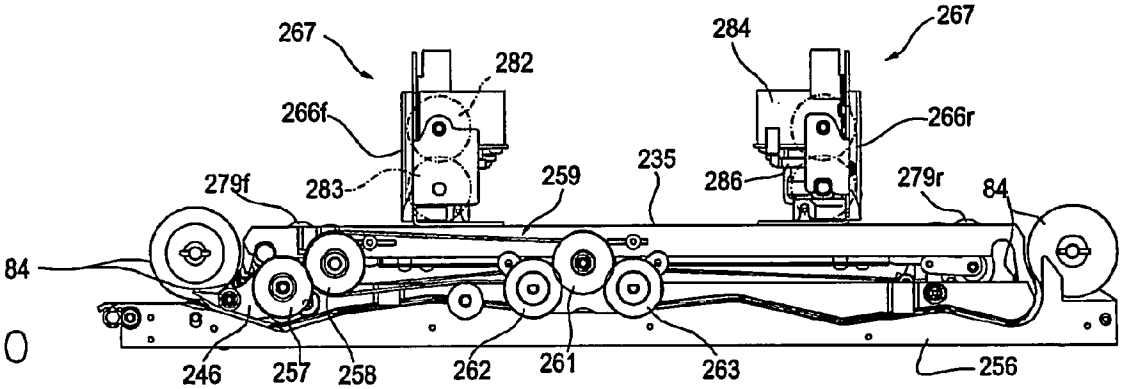
FIG. 10 represents a partial schematic lateral section of some components of the module or box of the invention.

Suitably, the counter-frame 256 is fulcrumed on the frame 233 in proximity of an front end, with possibility of opening for the access to the alternative path 249°, as represented in dots and dashes in FIG. 9, as for the elimination of possible jams of the banknotes processed by the box 32-*i*, or for maintenance. In turn, the box is mounted on the tray 77 with possibility of turnover of 90° in its position of service, so as to allow the opening of the guiding and moving elements 247, as represented in dots and dashes in FIG. 2.

For the moving of the banknote stacks 238*f*, 238*r*, the box 32-*i* includes a pair of pressing elements 266*f* and 266*r* (FIGS. 3, 8 and 9) mounted on respective carriages 267 to push in independent way the banknote stacks against the respective insertion and extraction devices 241*f*, 241*r*. Two pairs of supporting belts 268*f* and 268*r* (FIGS. 13, 14 and 15) project of little with respect to the upper surface of the plate of base 235, with function of support for the lower edges of the stacks 238*f* and 238*r*.

Figure 12:
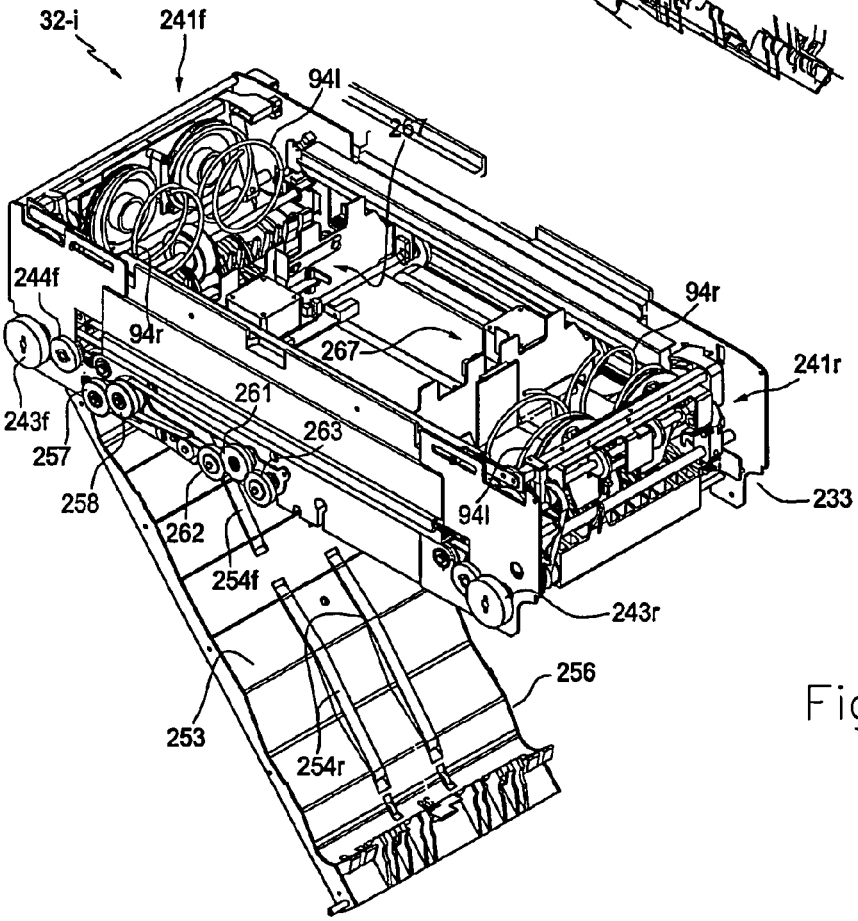
FIG. 12 is a perspective view from the top of some components of the module or box in the condition of service of FIG. 11.

Each belt 268*f*, 268*r* extends, with a higher branch, from the carriage 267 of the pressing element 266*f*, 266*r* up to a window of the plate of base 235 in a terminal area 269*f* and 269*r*, as represented in FIG. 12, and returning with a lower branch toward the opposed terminal area 269*r* and 269*f*. An end 271 of the belt 268*f*, 268*r* is fixed to the carriage; the opposite end 272 is arranged underneath the plate 235, while a restoring member 273 maintains in tension the belt 268*f*, 268*r* during the moving of the pressing element 266*f*, 266*r*.

Specifically, each belt 268*f*, 268*r* is supported between the higher branch and the lower branch by a fixed pulley 274, rotatable in correspondence of the window of the terminal area 269*f* and 269*r*. The restoring member 273 includes a movable pulley 276 and a respective spring 277 arranged below the plate of base 235. The pulley 276 engages the lower branch of each belt, while the respective spring 277 is operative on the same pulley 276. The opposite end 272 of each belt 268*f*, 268*r* is fixed to the lower portion of the area 269*f* and 269*r*, while the spring 277, of rectilinear action, is extended between the pulley 276 and the lower portion of the area 269*r*, 269*f*.

With this structure, the belts 268*f*, and 268*r* can support and follow, without mutual interferences, the movement of the stacks 238*f*, 238*r* of different extensions through the useful space of the seat 234. The corresponding stroke of the movable pulley 276 and the deformation of the spring are the half of the stroke of the carriages 267.

Figure 14:
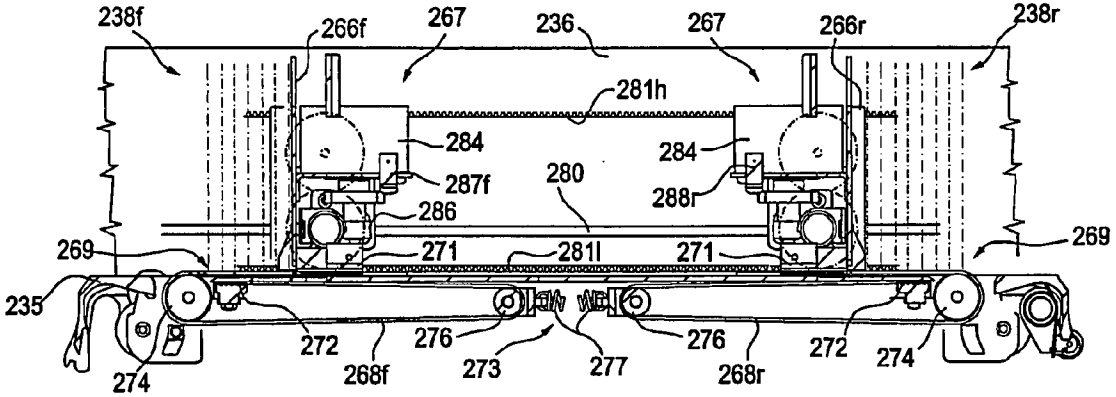
FIG. 14 represents a partial schematic lateral section of further components of the module or box of the invention.
Figure 15:
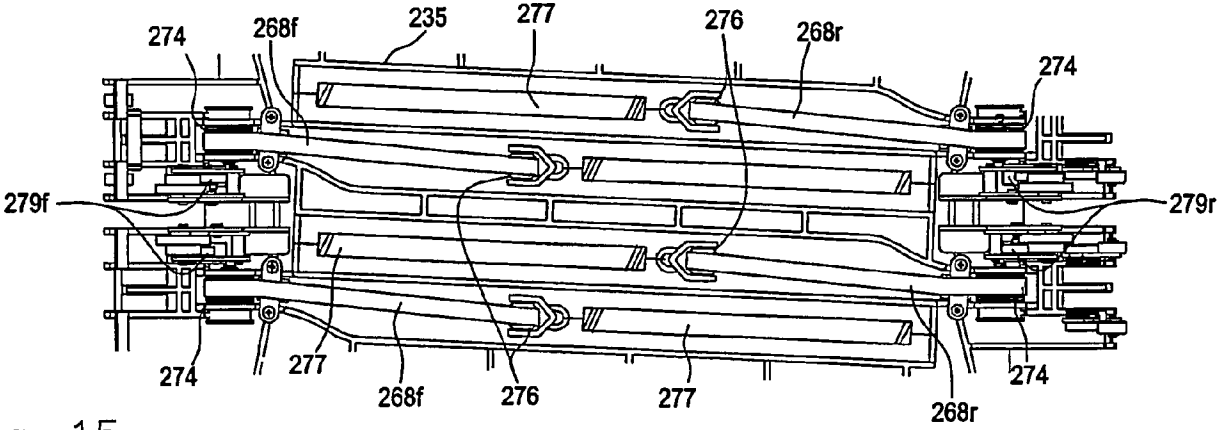
FIG. 15 is a view from the bottom of some components shown in FIG. 14.

The upper branches of the pairs of belts 268*f* and the upper branches of the pairs of belts 268*r* are lodged in a pair of common sliding seats 278 (FIGS. 13 and 14). The seats 278 are obtained in the upper portion of the plate 235 between the windows of the terminal areas 269*f* and 269*r*, with axes parallel to the sense of movement of the pressing elements 266*f* and 267*r*. In turn, as shown in FIG. 14, the lower branches of the pairs of belts 268*f* and 268*r* and the springs 277 are slightly tilted in opposite sense, with respect to the upper branches. Thus, the dimensions in height requested for the two pairs of belts 268*f*, and 268*r* are substantially equal to the dimensions of the supporting belts of a box 32 for a single type of banknotes.

Moreover, the movement of the banknote stacks 238*f*, 238*r* is made easier by feeding rollers 279*f* and 279*r* (FIGS. 10 and 13), projecting of few from the plate of base 235 and interposed between the windows of the areas 269*f* and 269*r* and the ends of the plate 235, adjacent to the area of engagement between the rollers 84.

In the double box 32-*i*, the walls 236 (FIGS. 8, 9 and 12) are provided each one with an upper rack 281*h*, a lower rack 281*l* and a guide 280 between the racks, extended parallel to the sense of stacking 239. Each carriage 267 laterally supports, in the rotation, two pairs of identical gears 282 and 283, in mutual engagement and in engagement with the two racks 281*h* and 281*l*. The gears 282 and 283 are arranged one above the other, with the gears 283 of each carriage keyed on a common shaft 285. The shaft 285 has ends projecting from the gears 283 and slidably engaged in the guide 280.

A motor 284 is mounted on board of each carriage 267 and actuates the pairs of gears 282 and 283 through a return group 286 and the shaft 285. Thus the carriages 267 advance in view of the rotation of the gears with respect to the racks 281*h* and 281*l*. Such structure ensures a balanced moving, devoid of jams, also in the case of banknote stacks 238*f*, 238*r* in condition of maximum extension.

Conveniently, the components mounted on the carriages 267 have a specular configuration for minimum dimensions in condition of maximum filling of the banknote seat. In detail, as shown in the plan view of FIG. 13, the motor 284 and the return group 286 for the pressing element 266*f* are mounted on a side of the carriage 267, while the motor 284 and the group 286 for the pressing element 266*r* are mounted on the opposite side of the other carriage 267.

The condition of full box for the stack of banknotes 238*f*, 238*r* is recognized by sensors 287*f*, 287*r* mounted on the respective carriages 267, which are actuatable by corresponding actuating elements 288*f*, 288*r*. The active components of the carriages 267 are connected with a connector of the box (not shown) through cables carried in symmetrical way by corresponding chain supports (also not shown) adjacent to the walls 236. Other sensors (not numbered in the figures) are arranged along the paths of the banknotes for verifying the transit thereof in predetermined sections of the guiding and moving elements 247.

A double box with this arrangement can be used in an equipment for the automatic deposit and withdrawal of banknotes, having a general structure with frontal door store safe and vertically overlapped housings for the boxes. The respective store transport mechanism is unique for the two stacks of banknotes of the box and has substantially vertical path, adjacent to the door safe and is easily accessible for inspections and for the elimination of possible jams.

Naturally, the principle of the invention remaining the same, the embodiments and the details of construction of the equipment for the automatic deposit and withdrawal of banknotes and the relative receipting and dispensing boxes can broadly be varied with respect to what has been described and illustrated, by way of non-limitative example, without departing from the ambit of the invention.

The invention claimed is:

1. An equipment for the automatic deposit and withdrawal of banknotes comprising a series of banknote receipting and dispensing boxes, a store safe with a door safe, a series of housings for said boxes arranged overlapped in said safe and a store transport mechanism for the banknotes with substantially vertical path adjacent to the door safe and actuatable for the moving of the banknotes with respect to said housings; said equipment using at least one double receipting and dispensing box which stores, in an single banknote seat, banknotes of different typology with subdivision on a first stack and a second stack arranged one behind the other;

said double receipting and dispensing box is horizontal in the use, defines a front and a back and locates internally the banknote seat, a reference insertion and extraction device and another insertion and extraction device for the insertion and the extraction of the banknotes with respect to the first stack and the second stack, a first pressing element and a second pressing element, and actuating means for said first pressing element and said second pressing element;

wherein said single banknote seat is of lengthened substantially parallelepiped shape with a first terminal section and a second terminal section close, respectively, to the front and the back of the box and a common space between the first terminal section and the second terminal section and in which the first stack and the second stack have each one possibly of use of the common section;

wherein said first terminal section and said second terminal section locate, respectively, the reference insertion and extraction device and the other insertion and extraction device, while the two pressing elements are arranged in the common space; and wherein the banknotes are arranged in vertical one behind the other along a common horizontal stacking direction on the first stack and the second stack from the first terminal section and the second terminal section to the pressing elements and support on a longer edge of the banknotes and such that the extension of the common space depends on the extensions of the first stack and the second stack, said double receipting and dispensing box further comprising:

an input-output passage, close to said front of the box, for making the banknotes to transit from the transport mechanisms to the first stack and the second stack and from the first stack and the second stack to the transport mechanisms;

a diverting member arranged internally to said box downwardly from the input-output passage close to said first terminal section and actuatable between a direct configuration and an alternative configuration; and guiding and moving elements for guiding and moving the banknotes between the diverting member and the other insertion and extraction device;

said diverting member being provided for causing the banknotes to transit between the input-output passage and the reference insertion and extraction devices in said direct configuration and to transit between the input-output passage and the other insertion and extraction device in the alternative configuration; and said first pressing element and said second pressing element being provided for cooperating with a respective end of the first stack and the second stack and being moved by said actuating means for pushing, in independent way, a beginning of the first stack towards the first terminal section and a beginning of the second stack towards the second terminal section, along the stacking direction, against the reference insertion and extraction device and, respectively, against the other insertion and extraction device.

2. Equipment according to claim 1 wherein the insertion and extraction devices for the double box include each one introduction-extraction rollers for moving entering banknotes and emerging banknotes, a separation member for stacking the entering banknotes and a separation roller for separating banknotes from said stacks: in which said double box further comprises a couple of taking members and a couple of transit taking members, said taking members being functional to the separation member of the insertion and extraction devices and the couple of transit taking members being provided for the actuation of the introduction-extraction rollers; said equipment comprising a couple of introduction-extraction motors and a couple of configuration motors, and in which the couple of transit taking member is actuatable by the couple of introduction-extraction motors, while the couple of configuration taking members is actuatable by the couple of introduction-extraction motors.

3. Equipment according to claim 1, further comprising guides for said receipting and dispensing boxes having possibility of sliding in a position of service externally to the housings, in which the guiding and moving elements are arranged in a lower portion of the double receipting and dispensing box and define paths of guide for banknotes in transit with respect to the first insertion and extraction device and the second insertion and extraction device, in which said guiding and moving elements have possibility of opening for the access to said paths guide, and in which said double receipting and dispensing box is mounted on a couple of the said guides with possibility of upsetting in said position of service to allow the opening of the banknote guiding and moving elements.

* * * * *